US011428411B1

(12) United States Patent
Pal et al.

(10) Patent No.: US 11,428,411 B1
(45) Date of Patent: Aug. 30, 2022

(54) SWIRLER WITH RIFLED VENTURI FOR DYNAMICS MITIGATION

(71) Applicant: General Electric Company, Schenectady, NY (US)

(72) Inventors: Sibtosh Pal, Mason, OH (US); Clayton S. Cooper, Loveland, OH (US); Nicholas R. Overman, Sharonville, OH (US); Steven C. Vise, Loveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/323,512

(22) Filed: May 18, 2021

(51) Int. Cl.

| | |
|---|---|
| ***F23R 3/14*** | (2006.01) |
| ***F23R 3/28*** | (2006.01) |
| ***F23R 3/12*** | (2006.01) |
| ***F23R 3/16*** | (2006.01) |

(52) U.S. Cl.
CPC ..... *F23R 3/12* (2013.01); *F23R 3/14* (2013.01); *F23R 3/16* (2013.01); *F23R 3/286* (2013.01)

(58) Field of Classification Search
CPC ..... F23R 3/12; F23R 3/14; F23R 3/286
See application file for complete search history.

(56) References Cited

U.S. PATENT DOCUMENTS 3,638,865 A 2/1972 McEneny et al.
3,720,058 A 3/1973 Collinson et al.
3,853,273 A * 12/1974 Bahr ..... F23R 3/14 239/404
3,859,787 A 1/1975 Anderson et al.
4,180,974 A * 1/1980 Stenger ..... F23R 3/14 60/756
5,274,995 A * 1/1994 Horner ..... F23R 3/28 60/737
5,321,951 A * 6/1994 Falls ..... F23R 3/34 60/740
6,170,762 B1 1/2001 Sumida et al.
6,212,870 B1 * 4/2001 Thompson ..... F23R 3/60 60/746
6,314,739 B1 * 11/2001 Howell ..... F23R 3/14 60/748
6,442,940 B1 * 9/2002 Young ..... F23R 3/14 29/890.01
6,487,861 B1 * 12/2002 Carita ..... F02C 3/24 60/737
6,824,085 B2 11/2004 Sebastian et al.
(Continued)

FOREIGN PATENT DOCUMENTS

JP 2000320431 A 11/2000

*Primary Examiner* — William H Rodriguez
(74) *Attorney, Agent, or Firm* — Venable LLP; Edward A. Kmett; Michele V. Frank

(57) ABSTRACT

A venturi for a swirler assembly of a combustor for a gas turbine engine. The venturi has an annular wall having internal diameter of a forward end of the annular wall that is larger than an internal diameter of a middle portion of the annular wall, which is smaller than an internal diameter of an aft end of the annular wall. The internal surface of the annular wall has a plurality of grooves extending in a longitudinal direction from the forward end of the annular wall to the aft end of the annular wall. The plurality of grooves are angled with respect to a centerline axis of the annular wall and may be spiraled about the internal surface of the annular wall.

20 Claims, 7 Drawing Sheets

(56) References Cited

U.S. PATENT DOCUMENTS

| | | | | |
|---|---|---|---|---|
| 7,658,075 | B2 | 2/2010 | von der Bank | |
| 8,291,706 | B2 | 10/2012 | Tanner et al. | |
| 2003/0010034 | A1* | 1/2003 | Baudoin | F23R 3/286 60/740 |
| 2003/0131600 | A1* | 7/2003 | David | F23D 11/107 60/737 |
| 2005/0044854 | A1* | 3/2005 | Cazalens | F23R 3/286 60/740 |
| 2006/0064983 | A1* | 3/2006 | Currin | F23R 3/50 60/752 |
| 2009/0255120 | A1* | 10/2009 | McMasters | F23R 3/14 29/428 |
| 2009/0255261 | A1* | 10/2009 | McMasters | F23R 3/343 60/737 |
| 2016/0305327 | A1* | 10/2016 | Patel | F23R 3/14 |
| 2017/0067638 | A1* | 3/2017 | Le Pannerer | F23R 3/283 |
| 2020/0248903 | A1* | 8/2020 | Sampath | F23R 3/14 |

* cited by examiner

SWIRLER WITH RIFLED VENTURI FOR DYNAMICS MITIGATION

TECHNICAL FIELD

The present disclosure relates to a fuel nozzle venturi in a rich-burn combustor for a gas turbine engine.

BACKGROUND

Some conventional gas turbine engines are known to include rich-burn combustors that typically use a swirler integrated with a fuel nozzle to deliver a swirled fuel/air mixture to a combustor. A radial-radial swirler is one example of such a swirler and includes both a primary radial swirler and a secondary radial swirler in tandem. A combustor with a radial-radial swirler also includes a venturi and a fuel nozzle that injects fuel into the venturi. The primary swirler is connected with the venturi to provide a flow of air to mix with the fuel injected into the venturi by the fuel nozzle so as to provide an air-borne fuel/air mixture within the opening of the venturi. The secondary swirler is connected to a flow passage outward of the venturi and provides a flow of air downstream of the venturi to mix with the fuel/air mixture exiting the venturi. In the conventional venturi, some of the fuel adheres to an inner surface of the venturi and flows to a downstream exit of the venturi. At the exit, the fuel on the surface of the venturi forms a thin liquid sheet that atomizes with the fuel/air mixture exiting the venturi, as well as mixes with the air flow from the secondary swirler.

BRIEF SUMMARY

According to one aspect, the present disclosure relates to a venturi for a swirler of a combustor for a gas turbine engine. According to this aspect, the venturi includes an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall. The annular wall further includes an internal surface and an outer surface. An internal diameter of the forward end of the annular wall is larger than an internal diameter of a middle portion of the annular wall between the forward end of the annular wall and the aft end of the annular wall, and the internal diameter of the middle portion of the annular wall is smaller than an internal diameter of the aft end of the annular wall.

The venturi of this aspect of the disclosure further includes a forward wall extending radially outward with respect to the centerline axis, and a transition wall connecting the forward wall and the forward end of the annular wall. The transition wall has an internal surface extending from a forward surface of the forward wall to the internal surface of the annular wall. The internal surface of the annular wall includes a plurality of grooves in the internal surface of the annular wall, the plurality of grooves extending in the longitudinal direction along the internal surface of the annular wall, and each of the plurality of grooves having a groove forward end and a groove aft end.

According to another aspect, the present disclosure, relates to a fuel/oxidizer swirler for a combustor of a gas turbine engine. The fuel/oxidizer swirler of this aspect includes a forward oxidizer inlet swirler including a plurality of swirl vanes, the forward oxidizer inlet swirler including a fuel/oxidizer inlet arranged radially inward of the plurality of swirl vanes. The fuel/oxidizer inlet swirler of this aspect further includes a venturi disposed longitudinally aft of the forward oxidizer inlet swirler, and an aft oxidizer inlet swirler arranged radially outward of the venturi. The aft oxidizer inlet swirler includes a plurality of swirl vanes arranged radially outward of the venturi.

The venturi of this aspect includes an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall. The annular wall includes an internal surface and an outer surface, where an internal diameter of the forward end of the annular wall is larger than an internal diameter of a middle portion of the annular wall between the forward end of the annular wall and the aft end of the annular wall. The internal diameter of the middle portion of the annular wall is smaller than an internal diameter of the aft end of the annular wall. The venturi further includes a forward wall extending radially outward with respect to the centerline axis and having a forward surface, where the forward wall defines an aft wall of the forward oxidizer inlet swirler.

The venturi of this aspect further includes a transition wall connecting the forward wall and the forward end of the annular wall, where the transition wall has an internal surface extending from the forward surface of the forward wall to the internal surface of the annular wall. The internal surface of the annular wall includes a plurality of grooves in the internal surface of the annular wall, the plurality of grooves extending in the longitudinal direction along the internal surface of the annular wall, and each of the plurality of grooves having a groove forward end and a groove aft end.

Additional features, advantages, and embodiments of the present disclosure are set forth or apparent from consideration of the following detailed description, drawings, and claims. Moreover, it is to be understood that both the foregoing summary and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
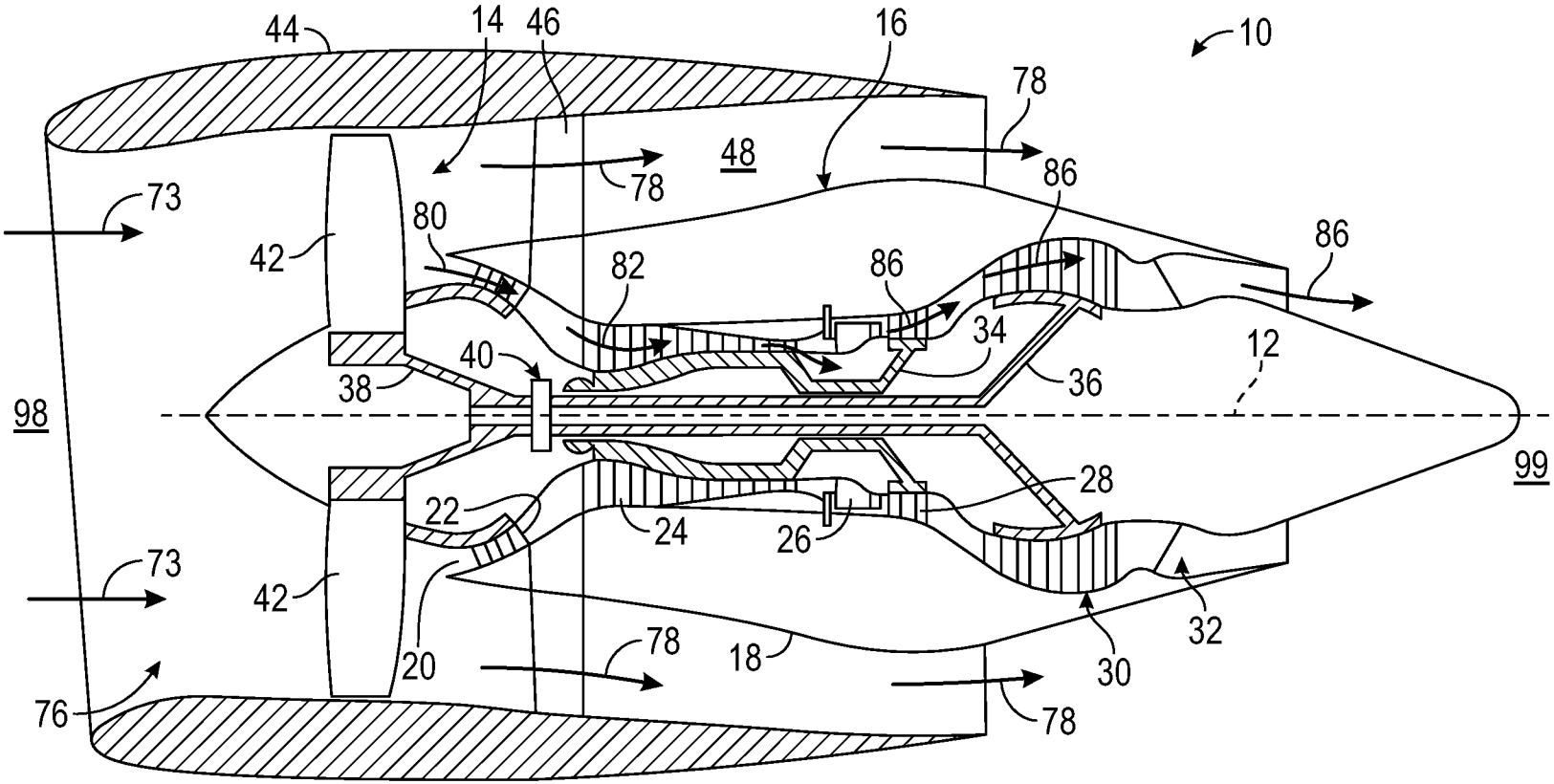
FIG. 1 is a schematic partial cross-sectional side view of an exemplary high by-pass turbofan jet engine, according to an embodiment of the present disclosure.

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

As was briefly discussed above, in conventional rich-burn combustors having a radial-radial swirler and a venturi, some of the fuel adheres to an inner surface of the venturi and flows to a downstream exit of the venturi. At the exit, the fuel on the surface of the venturi forms a thin liquid sheet that atomizes with the fuel/air mixture exiting the venturi, as well as mixing with the air flow from the secondary swirler. For this type of architecture, the flow usually has high-frequency spectral components that can couple with transverse modes of the combustion chamber, and also low-frequency spectral content that are usually axial in nature. Both types of flow spectral components are usually driven by the location of fuel within the swirler's venturi. In general, the lower the air-borne fuel within the venturi, the lower the flow's high-frequency spectral levels. However, the flow's low-frequency spectral levels increase with lower air-borne fuel within the venturi (i.e., in an opposite manner). This indicates that the flow's low-frequency spectral content is largely driven by coherent atomization of the liquid fuel from the exit of the swirler's venturi.

The present disclosure aims to address the foregoing by affecting the coherent liquid sheet breakup/atomization at the venturi exit. In the present disclosure, a venturi for a swirler of a combustor for a gas turbine engine includes rifling-type grooves about the inner circumferential surface of the venturi. The specific arrangement of the rifling-type grooves can be determined based on the dynamics affects to be achieved. For example, the width of the grooves may vary from application to application (i.e., different types of combustors), or may vary from the forward end (inlet) of the venturi to the aft end (exit) of the venturi, or may vary circumferentially. The depth of the grooves may also vary from application to application, or may vary from the forward end to the aft end of the venturi, or may vary circumferentially. The grooves may also be angled with respect to a centerline axis of the venturi, or may be spiraled about the circumference. The beginning point and ending point of the grooves along the length of the venturi may also vary depending on the particular application, or a desired dynamics effect to be achieved. The spacing between the grooves can also vary. One object of the rifling-type grooves is to break up the otherwise coherent thin liquid sheet exiting the venturi, which reduces the flow's low-frequency spectral content. The grooves also help to reduce the air-borne fuel/air content so as to help reduce the flow's high-frequency spectral content. The present disclosure can further help to reduce the flow's low-frequency spectral content that may arise from swirler changes that are designed to lower the flow's high-frequency spectral content.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial engine centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween in which a bypass airflow 78 passes therethrough.

Figure 2:
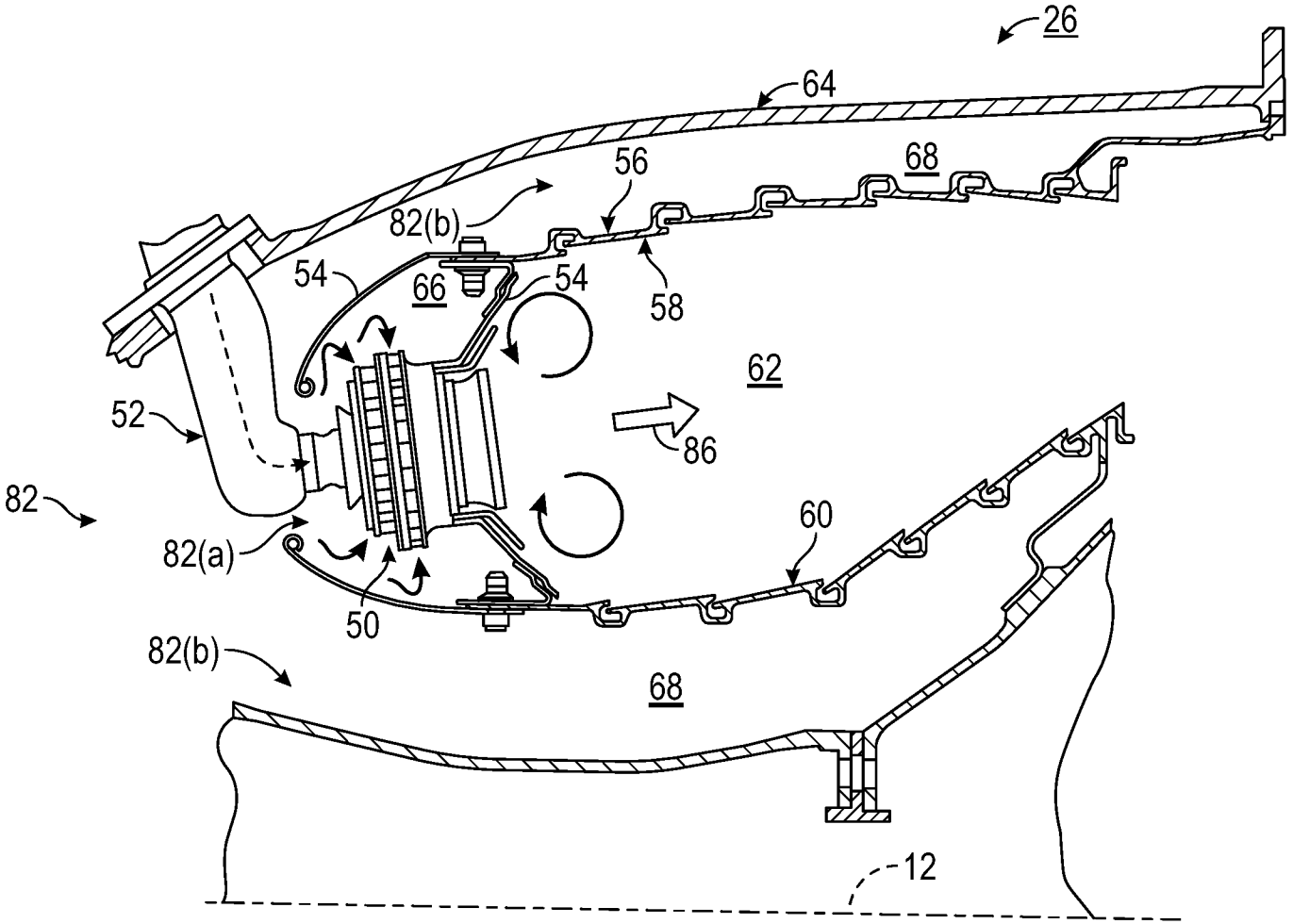
FIG. 2 is a partial cross-sectional side view of an exemplary combustion section, according to an embodiment of the present disclosure.

FIG. 2 depicts an exemplary combustion section 26 according to the present disclosure. In FIG. 2, combustion section 26 includes a swirler assembly 50, fuel nozzle assembly 52, dome assembly 54, and an annular combustion liner 56 within outer casing 64. The annular combustion liner 56 includes an annular outer liner 58 and an annular inner liner 60 forming a combustion chamber 62 therebetween. A pressure plenum 66 is formed within the dome assembly 54. In operation, air 73 enters the nacelle 44, and a portion of the air 73 enters the compressor section as compressor inlet air flow 80, where it is compressed. Air 82 from the compressor section (22/24) enters the combustion section 26 via a diffuser (not shown). A portion of the air 82(*a*) enters the dome assembly 54 to the pressure plenum 66, while another portion of the air 82(*b*) passes to an outer flow passage 68 between the annular combustion liner 56 and the outer casing 64. As will be described below, air 82(*a*) in the pressure plenum 66 passes through the swirler assembly 50 to mix with fuel ejected by a fuel nozzle of the fuel nozzle assembly 52 and is ignited to generate combustion product gases 86.

Figure 3:
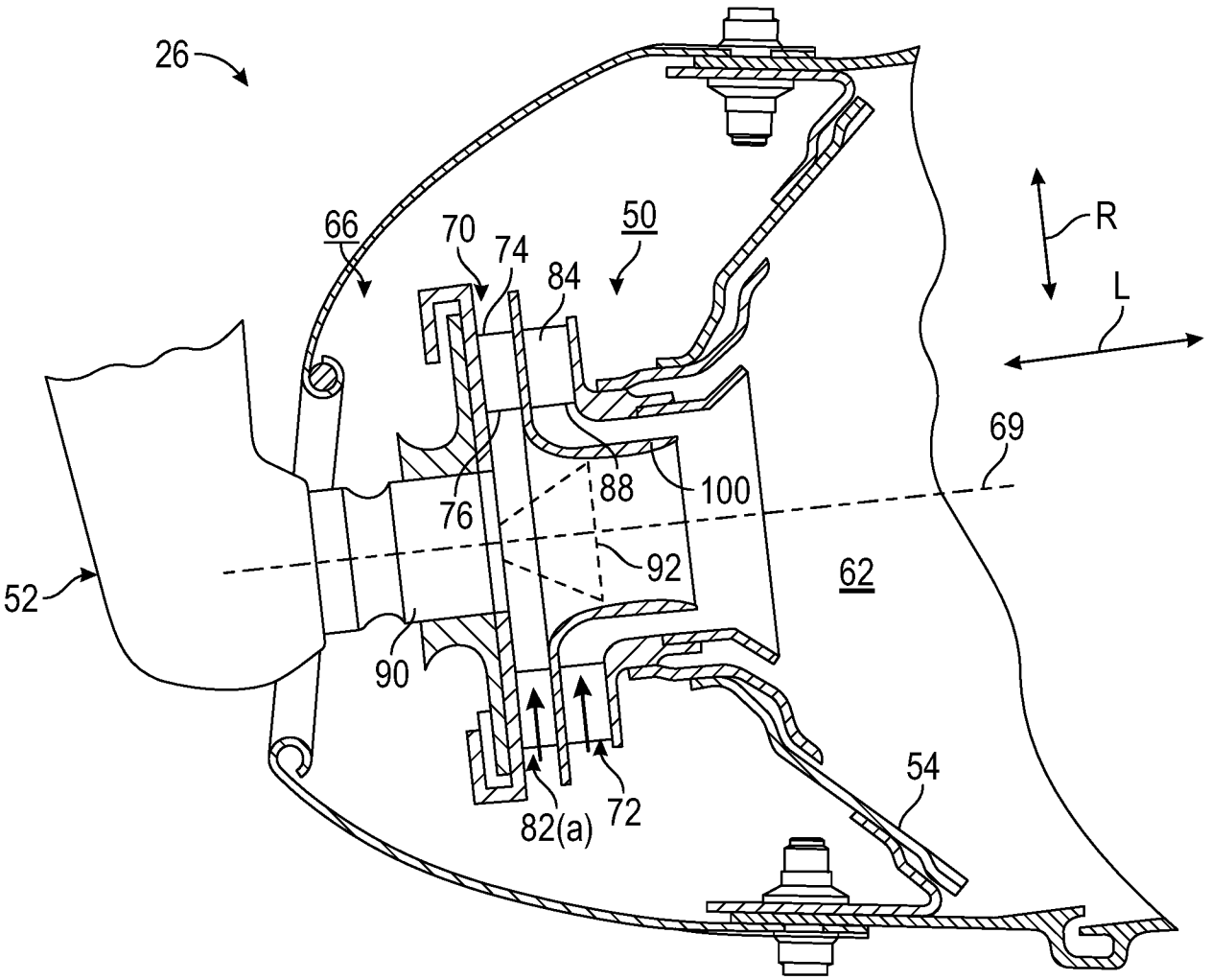
FIG. 3 is a partial cross-sectional view of a forward portion of a combustor, according to an embodiment of the present disclosure.

FIG. 3 depicts a partial cross-sectional view of a forward portion of a combustor in the combustion section 26, including swirler assembly 50. In FIG. 3, the combustion section 26 defines its own longitudinal direction L and radial direction R relative the engine centerline axis 12. The swirler assembly 50 is symmetrical about centerline axis 69, which extends in the longitudinal direction L and is perpendicular to the radial direction R. The swirler assembly 50 is suitably connected to dome assembly 54. The swirler assembly 50 includes a primary swirler 70, a secondary swirler 72, and a venturi 100. The primary swirler 70 (i.e., a forward oxidizer inlet swirler) includes a plurality of swirl vanes 74. The swirl vanes 74 are circumferentially disposed in a row such that each of the swirl vanes 74 extends radially inward to a vane lip 76. Thus, the primary swirl of 70 is configured for swirling a corresponding portion of the pressurized air 82(*a*) from the pressure plenum 66 radially inwardly from the plurality of swirl vanes 74 of the primary swirler 70.

The secondary swirler 72 (i.e., an aft oxidizer inlet swirler) similarly includes swirl vanes 84 that are circumferentially disposed in a row such that each of the swirl vanes 84 extends radially inward to a vane lip 88. Thus, the secondary swirl of 72 is configured for swirling another corresponding portion of the pressurized air 82(*a*) from the pressure plenum 66 radially inward from the plurality of swirl vanes 84 of secondary swirler 72.

The fuel nozzle assembly 52 is seen to include a fuel nozzle 90 disposed within a forward portion of the swirler assembly 50. The fuel nozzle 90 ejects a fuel 92 into the venturi 100 where it is mixed with the air 82(*a*) from primary swirler 70. The fuel air mixture in the venturi further mixes downstream with the air 82(*a*) from secondary swirler 72 downstream of the venturi 100. The venturi 100 radially separates the air swirled from the swirl vanes 74 and the swirl vanes 84. As will be described in more detail below, an inner flow surface of the venturi 100 converges to a throat of minimum flow area and then diverges to the outlet end thereof for discharging the fuel and air mixture from the swirler.

Figure 4:
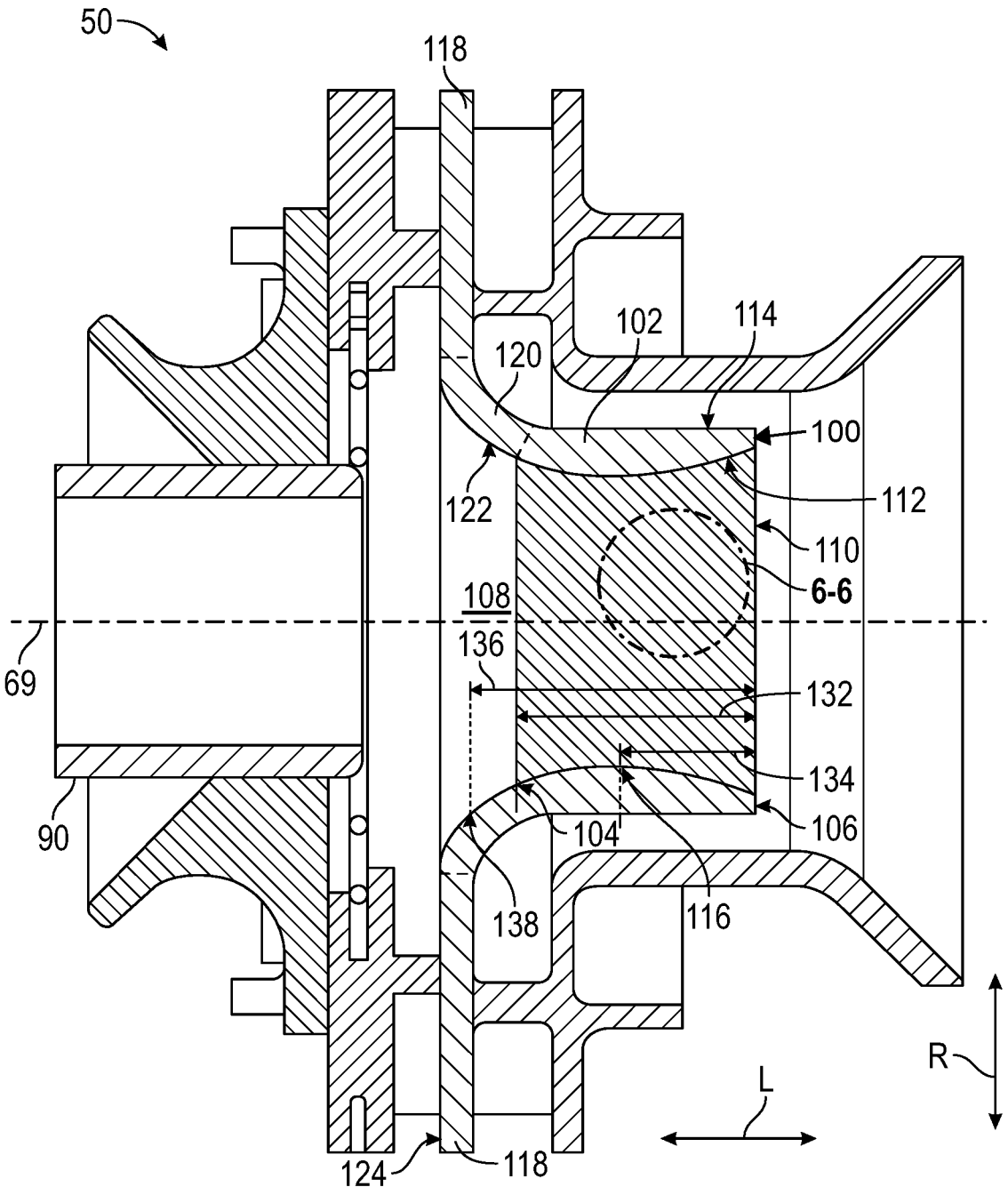
FIG. 4 is a partial cross-sectional view of a radial-radial swirler and venturi, according to an embodiment of the present disclosure.
Figure 5:
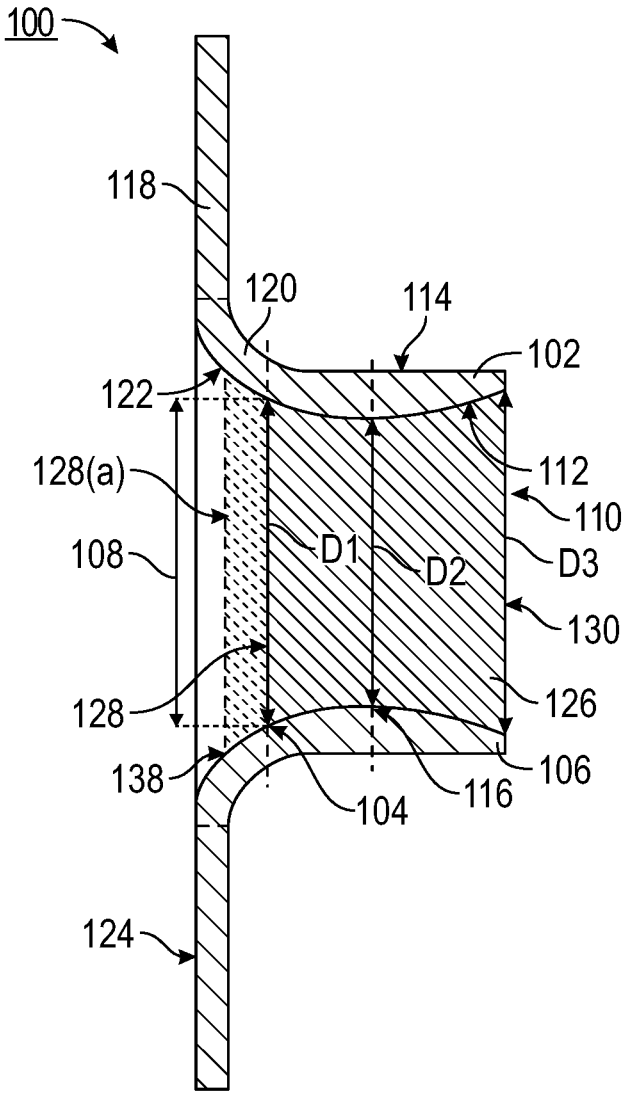
FIG. 5 is a cross-sectional view of an exemplary venturi according to an embodiment of the present disclosure.

FIG. 4 depicts a partial cross-sectional view of swirler assembly 50, including venturi 100, which will now be described in more detail. Venturi 100 is seen to include an annular wall 102 extending in a longitudinal direction L along centerline axis 69 from a forward end 104 of the annular wall to an aft end 106 of the annular wall, and extending radially (R) outward from the centerline axis 69. The annular wall 102 defines a fuel/oxidizer inlet 108 at the forward end 104 of the annular wall 102, and a fuel/oxidizer outlet 110 at the aft end 106 of the annular wall 102. The annular wall 102 includes an internal surface 112 and an outer surface 114. As seen in FIG. 5, an internal diameter D1 of the forward end 104 of the annular wall is larger than an internal diameter D2 of a middle portion 116 of the annular wall 102 between the forward end 104 and the aft end 106 of the annular wall 102. Additionally, the internal diameter D2 of the middle portion 116 of the annular wall 102 is smaller than an internal diameter D3 of the aft end 106 of the annular wall 102. Thus, the middle portion 116 forms a throat of the venturi 100.

In FIGS. 4 and 5, the venturi 100 further includes a forward wall 118 extending radially outward with respect to the centerline axis 69, and a transition wall 120 connecting the forward wall 118 and the forward end 104 of the annular wall 102. The transition wall has an internal surface 122 extending from a forward surface 124 of the forward wall 118 to the internal surface 112 of the annular wall 102. The forward surface 124 of the forward wall and a portion of the internal surface of the transition wall form an aft wall portion of the primary swirler 70.

Figure 6:
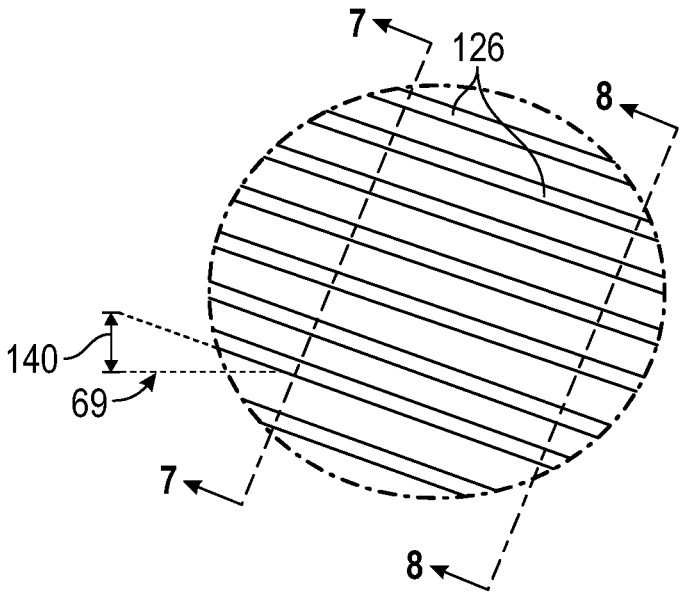
FIG. 6 depicts a close-up view of rifling grooves in a venturi, according to an embodiment of the present disclosure.

FIG. 6 is an enlarged view taken at 6-6 (see FIG. 4) of the internal surface 112 of the annular wall 102. In FIG. 6, the internal surface 112 of the annular wall 102 has a plurality grooves 126 (i.e., rifling-type grooves) about the inner circumference of the annular wall 102. The grooves 126 about the inner surface of the venturi provide for better adherence of the fuel to the surface of the venturi, and breakup the coherent thin sheet of fuel exiting the venturi, thereby, affecting the flow's spectral content. The grooves 126 are generally circumferentially spaced equidistant from one another and extend in the longitudinal direction L along the internal surface 112 of the annular wall 102. The grooves 126 may also be formed in a spiral manner about the internal surface 112 of the annular wall 102. For an axial length along the internal surface 112 of the grooves, the following description will be made with reference to a length of the grooves in the longitudinal direction L with respect to the centerline axis 69. Of course, an actual length of spiral grooves may be longer than the mere axial length, particularly when the grooves are spiraled, but the following description is merely to provide a definition of a groove starting point and a groove ending point in the axial direction.

Referring back to FIGS. 4 and 5, in defining the groove length, each of the grooves has a forward end 128 and the aft end 130. In one aspect, the grooves may extend, in the longitudinal direction L, a length 132 from the forward end 104 of the annular wall 102 to the aft end 106 of the annular wall 102. In another aspect, the grooves 126 may extend a length 134 from the middle portion 116 of the annular wall 102 to the aft end 106 of the annular wall 102. In another aspect, the grooves 126 may have a forward end 128(*a*) (FIG. 5) and extend a length 136 from a middle portion 138 of the transition wall 120 to the aft end 106 of the annular wall 102. In still further aspects, the grooves 126 may terminate along the length of the internal surface 112 prior to reaching the aft end 106. For example, the grooves may commence at the forward end 104 of the annular wall 102 and extend to a point between the middle portion 116 of the annular wall 102 and the aft end 106 of the annular wall 102. Thus, a portion of the aft end of the venturi may be free of the grooves and contain a groove-free surface.

In FIG. 6, the grooves 126 are seen to be arranged at a groove angle 140. The groove angle 140 depicted in FIG. 6 is an angle in relation to centerline axis 69. In some embodiments, the groove angle may be thirty degrees. In other embodiments, the groove angle may be forty-five degrees. In still other embodiments, the groove angle may range from thirty to sixty degrees, or from zero to forty-five degrees. Of course, the present disclosure is not limited to the foregoing angles or range and other angles may be implemented instead, based on a desired dynamics mitigation based on the angle/direction of the swirl of the primary swirler.

In one aspect, the grooves 126 are angled or spiraled in the same direction as that of the primary swirl of the air from primary swirler 70. However, it can be understood that the grooves 126 may be arranged at an angle different from that of the primary swirl, such that the primary swirl of the primary swirler 70 is at least somewhat across the grooves 126.

Figure 7:
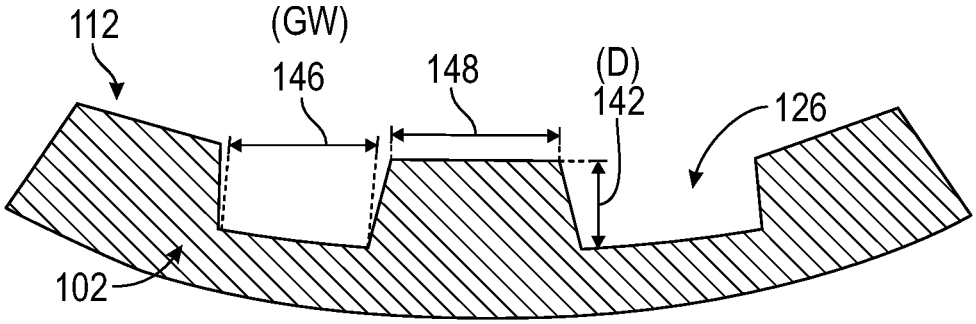
FIG. 7 depicts a partial cross-sectional view of a forward portion of rifling grooves in a venturi, according to an embodiment of the present disclosure, taken a line 7-7 in FIG. 6.
Figure 8:
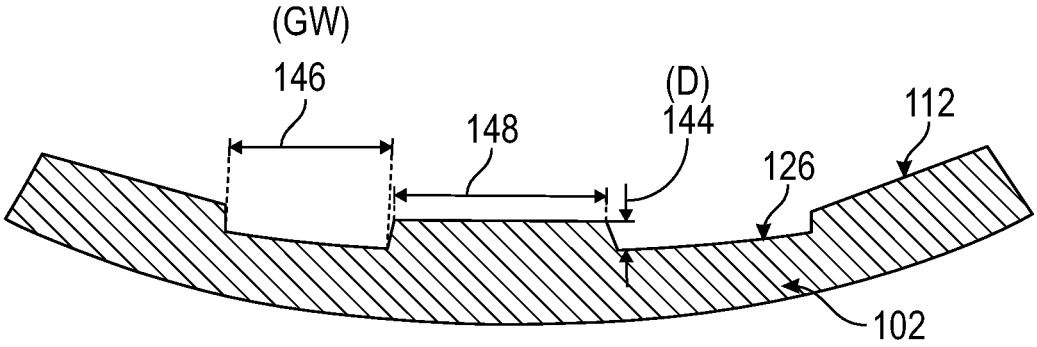
FIG. 8 depicts a partial cross-sectional view of an aft portion of rifling grooves in a venturi, according to an embodiment of the present disclosure, taken at line 8-8 in FIG. 6.

FIGS. 7 and 8 are partial cross-sectional views of the grooves 126. FIG. 7, taken along line 7-7 in FIG. 6, is a partial cross-sectional view of the grooves closer to the forward end 128, while FIG. 8, taken along line 8-8 in FIG. 6, is a partial cross-sectional view closer to the aft end 130 of the grooves. As seen in FIGS. 7 and 8, each of the grooves has a groove width (GW) 146. The groove width (GW) may be generally the same for each of the grooves, or it may vary from groove to groove. In some aspects, the groove width may be the same along the entire length of the groove, while in other aspects, the groove width may vary along the length of the groove. For example, the groove may be wider at the forward end and then narrower toward the aft end. In some aspects, the groove width may be about forty mils, but may have a range of between twenty mils to about one-hundred mils.

In FIGS. 7 and 8, each of the grooves 126 is seen to have a groove depth (D). In one aspect, the groove depth 142 at the forward end 128 of the groove 126 can be seen to be greater than the groove depth 144 of the same groove 126 at the aft end 130 of the groove 126. Of course, the groove depth could also be less than that at the forward end than at the aft end, or it could be equal along the entire length. The groove depth may be selected based on the desired dynamics mitigation to be achieved. In some aspects, the groove depth (D) may be a percentage of the groove width (GW) 146. For example, the groove depth may be about fifty percent of the groove width, while, in other aspects, the groove depth may range from twenty-five percent to seventy-five percent of the groove width.

Referring again to FIGS. 7 and 8, a portion of the internal surface 112 of the annular wall 102 between each of the grooves 126 defines a land width 148. In one aspect, the land width (LW) 148 (i.e., the spacing between the grooves) may be based on a percentage of the groove width, while, in another aspect, the land width (LW) may be a fixed distance. As for the percentage-based land width, the land width may range from fifty percent to one-hundred-fifty percent of the groove width. Of course, the present disclosure is not limited to the foregoing range and the size of the land width may be chosen based on the desired combustion dynamics.

Figure 9:
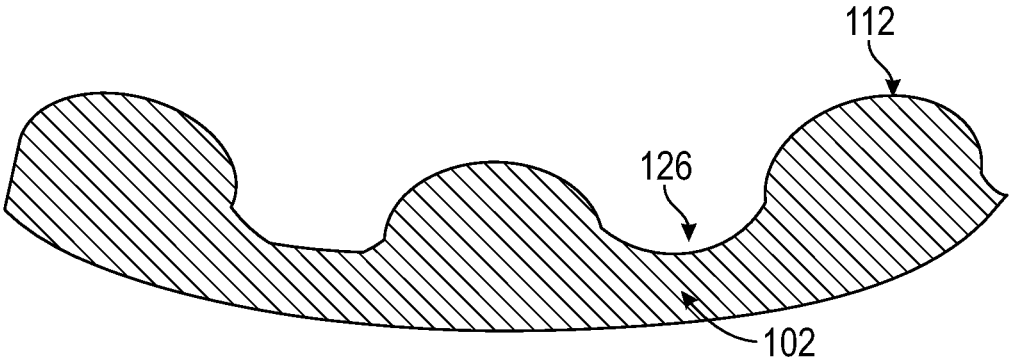
FIG. 9 depicts a partial cross-sectional view of rifling grooves in a venturi, according to another embodiment of the present disclosure.

As seen in FIGS. 7 and 8, a cross-sectional view of a shape of the grooves shows grooves that are generally trapezoidal so as to form a generally trapezoidal sine wave structure about the inner circumference of the annular wall 102. FIG. 9 depicts an example partial cross-sectional view of grooves that are generally rounded and form an oval shaped sine wave structure. Of course, the shape of the grooves is not limited to either of the foregoing and other shapes can be selected based on desired combustion dynamics to be achieved.

As was discussed above, the rifling-type grooves breakup the otherwise coherent thin liquid sheet exiting the venturi, which can reduce the flow's low-frequency spectral content. The grooves also help to reduce the air-borne fuel/air content so as to help reduce the flow's high-frequency spectral content. The present disclosure can further help to reduce low-frequency effects that may arise from swirler changes that are designed to lower flow's high-frequency effects.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A venturi for a swirler of a combustor for a gas turbine engine, the venturi comprising, an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall, wherein the annular wall includes an internal surface and an outer surface, and wherein an internal diameter of the forward end of the annular wall is larger than an internal diameter of a middle portion of the annular wall between the forward end of the annular wall and the aft end of the annular wall, and wherein the internal diameter of the middle portion of the annular wall is smaller than an internal diameter of the aft end of the annular wall, a forward wall extending radially outward with respect to the centerline axis, and a transition wall connecting the forward wall and the forward end of the annular wall, the transition wall having an internal surface extending from a forward surface of the forward wall to the internal surface of the annular wall, wherein the internal surface of the annular wall comprises a plurality of grooves in the internal surface of the annular wall, the plurality of grooves extending in the longitudinal direction along the internal surface of the annular wall, and each of the plurality of grooves having a groove forward end and a groove aft end.

The venturi according to any preceding clause, wherein the plurality of grooves are circumferentially spaced equidistant from one another about the internal surface of the annular wall.

The venturi according to any preceding clause, wherein the plurality of grooves extend, in the longitudinal direction, from the forward end of the annular wall to the aft end of the annular wall.

The venturi according to any preceding clause, wherein the plurality of grooves extend, in the longitudinal direction, from the middle portion of the annular wall to the aft end of the annular wall.

The venturi according to any preceding clause, wherein the plurality of grooves extend, in the longitudinal direction, from a middle portion of the transition wall to the aft end of the annular wall.

The venturi according to any preceding clause, wherein each of the plurality of grooves has a depth (D), and wherein the depth (D) of each of the plurality of grooves is greater at the groove forward end than at the groove aft end.

The venturi according to any preceding clause, wherein an angle of each of the plurality of grooves in the longitudinal direction in relation to the centerline axis has a range from zero to forty-five degrees.

The venturi according to any preceding clause, wherein each of the plurality of grooves has a groove width (GW), and the depth (D) of each of the plurality of grooves has a range from 25% to 75% of the groove width (GW).

The venturi according to any preceding clause, wherein each of the plurality of grooves has a groove width (GW), wherein a portion of the internal surface of the annular wall between each of the plurality of grooves defines a land, and wherein a land width (LW) of the land has a range from 50% to 150% of the groove width (GW).

The venturi according to any preceding clause, wherein, in a cross-sectional view orthogonal to the centerline axis through the annular wall, the plurality of grooves define a sine wave structure.

The venturi according to any preceding clause, wherein the sine wave structure is a trapezoidal sine wave structure.

A swirler assembly for a combustor of a gas turbine engine, the swirler assembly comprising, a primary swirler including a plurality of swirl vanes, the primary swirler including a fuel/oxidizer inlet arranged radially inward of the plurality of swirl vanes, a venturi disposed longitudinally aft of the primary swirler; and a secondary swirler arranged radially outward of the venturi, the secondary swirler including a plurality of swirl vanes arranged radially outward of the venturi, wherein the venturi comprises, an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall, wherein the annular wall includes an internal surface and an outer surface, an internal diameter of the forward end of the annular wall is larger than an internal diameter of a middle portion of the annular wall between the forward end of the annular wall and the aft end of the annular wall, and the internal diameter of the middle portion of the annular wall is smaller than an internal diameter of the aft end of the annular wall, a forward wall extending radially outward with respect to the centerline axis and having a forward surface, the forward wall defining an aft wall of the primary swirler, and a transition wall connecting the forward wall and the forward end of the annular wall, a forward end of the transition wall defining a fuel/oxidizer inlet, an internal diameter of the forward end of the transition wall being greater than the internal diameter of the forward end of the annular wall, and a diameter of an aft end of the transition wall being equal to the internal diameter of the forward end of the annular wall, the transition wall having an internal surface extending from the forward surface of the forward wall to the internal surface of the annular wall, wherein the internal surface of the annular wall comprises a plurality of grooves in the internal surface of the annular wall, the plurality of grooves extending in the longitudinal direction along the internal surface of the annular wall, and each of the plurality of grooves having a groove forward end and a groove aft end.

The swirler assembly according to any preceding clause, wherein the plurality of grooves are circumferentially spaced equidistant from one another about the internal surface of the annular wall.

The swirler assembly according to any preceding clause, wherein the plurality of grooves extend, in the longitudinal direction, from the forward end of the annular wall to the aft end of the annular wall.

The swirler assembly according to any preceding clause, wherein the plurality of grooves extend, in the longitudinal direction, from the middle portion of the annular wall to the aft end of the annular wall.

The swirler assembly according to any preceding clause, wherein the plurality of grooves extend, in the longitudinal direction, from a middle portion of the transition wall to the aft end of the annular wall.

The swirler assembly according to any preceding clause, wherein each of the plurality of grooves has a depth (D), and wherein the depth (D) of each of the plurality of grooves is greater at the groove forward end than at the groove aft end.

The swirler assembly according to any preceding clause, wherein an angle of each of the plurality of grooves in the longitudinal direction in relation to the centerline axis has a range from zero to forty-five degrees.

The swirler assembly according to any preceding clause, wherein each of the plurality of grooves has a groove width (GW), and the depth (D) of each of the plurality of grooves has a range from 25% to 75% of the groove width (GW).

The swirler assembly according to any preceding clause, wherein each of the plurality of grooves has a groove width (GW), wherein a portion of the internal surface of the annular wall between each of the plurality of grooves defines a land, and wherein a land width (LW) of the land has a range from 50% to 150% of the groove width (GW).

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

What is claimed is:

1. A venturi for a swirler of a combustor for a gas turbine engine, the venturi comprising:

an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall, wherein the annular wall includes an internal surface and an outer surface, and wherein an internal diameter of the forward end of the annular wall is larger than an internal diameter of a middle portion of the annular wall between the forward end of the annular wall and the aft end of the annular wall, and wherein the internal diameter of the middle portion of the annular wall is smaller than an internal diameter of the aft end of the annular wall;

a forward wall extending radially outward with respect to the centerline axis; and a transition wall connecting the forward wall and the forward end of the annular wall, the transition wall having an internal surface extending from a forward surface of the forward wall to the internal surface of the annular wall, wherein the internal surface of the annular wall comprises a plurality of grooves in the internal surface of the annular wall, the plurality of grooves extending in the longitudinal direction along the internal surface of the annular wall, and each of the plurality of grooves having a groove forward end and a groove aft end.

2. The venturi according to claim 1, wherein the plurality of grooves are circumferentially spaced equidistant from one another about the internal surface of the annular wall.

3. The venturi according to claim 1, wherein the plurality of grooves extend, in the longitudinal direction, from the forward end of the annular wall to the aft end of the annular wall.

4. The venturi according to claim 1, wherein the plurality of grooves extend, in the longitudinal direction, from the middle portion of the annular wall to the aft end of the annular wall.

5. The venturi according to claim 1, wherein the plurality of grooves extend, in the longitudinal direction, from a middle portion of the transition wall to the aft end of the annular wall.

6. The venturi according to claim 1, wherein each of the plurality of grooves has a depth (D), and wherein the depth (D) of each of the plurality of grooves is greater at the groove forward end than at the groove aft end.

7. The venturi according to claim 1, wherein an angle of each of the plurality of grooves in the longitudinal direction in relation to the centerline axis has a range from zero to forty-five degrees.

8. The venturi according to claim 6, wherein each of the plurality of grooves has a groove width (GW), and the depth (D) of each of the plurality of grooves has a range from 25% to 75% of the groove width (GW).

9. The venturi according to claim 1, wherein each of the plurality of grooves has a groove width (GW), wherein a portion of the internal surface of the annular wall between each of the plurality of grooves defines a land, and wherein a land width (LW) of the land has a range from 50% to 150% of the groove width (GW).

10. The venturi according to claim 1, wherein, in a cross-sectional view orthogonal to the centerline axis through the annular wall, the plurality of grooves define a sine wave structure.

11. The venturi according to claim 10, wherein the sine wave structure is a trapezoidal sine wave structure.

12. A swirler assembly for a combustor of a gas turbine engine, the swirler assembly comprising:

a primary swirler including a plurality of swirl vanes, the primary swirler including a fuel/oxidizer inlet arranged radially inward of the plurality of swirl vanes;

a venturi disposed longitudinally aft of the primary swirler; and a secondary swirler arranged radially outward of the venturi, the secondary swirler including a plurality of swirl vanes arranged radially outward of the venturi, wherein the venturi comprises:

an annular wall extending in a longitudinal direction along a centerline axis from a forward end of the annular wall to an aft end of the annular wall, and extending radially outward from the centerline axis, the annular wall defining a fuel/oxidizer inlet at the forward end of the annular wall, and a fuel/oxidizer outlet at the aft end of the annular wall, wherein the annular wall includes an internal surface and an outer surface, an internal diameter of the forward end of the annular wall is larger than an internal diameter of a middle portion of the annular wall between the forward end of the annular wall and the aft end of the annular wall, and the internal diameter of the middle portion of the annular wall is smaller than an internal diameter of the aft end of the annular wall;

a forward wall extending radially outward with respect to the centerline axis and having a forward surface, the forward wall defining an aft wall of the forward oxidizer inlet swirler; and a transition wall connecting the forward wall and the forward end of the annular wall, the transition wall having an internal surface extending from the forward surface of the forward wall to the internal surface of the annular wall, wherein the internal surface of the annular wall comprises a plurality of grooves in the internal surface of the annular wall, the plurality of grooves extending in the longitudinal direction along the internal surface of the annular wall, and each of the plurality of grooves having a groove forward end and a groove aft end.

13. The swirler assembly according to claim 12, wherein the plurality of grooves are circumferentially spaced equidistant from one another about the internal surface of the annular wall.

14. The swirler assembly according to claim 12, wherein the plurality of grooves extend, in the longitudinal direction, from the forward end of the annular wall to the aft end of the annular wall.

15. The swirler assembly according to claim 12, wherein the plurality of grooves extend, in the longitudinal direction, from the middle portion of the annular wall to the aft end of the annular wall.

16. The swirler assembly according to claim 12, wherein the plurality of grooves extend, in the longitudinal direction, from a middle portion of the transition wall to the aft end of the annular wall.

17. The swirler assembly according to claim 12, wherein each of the plurality of grooves has a depth (D), and wherein the depth (D) of each of the plurality of grooves is greater at the groove forward end than at the groove aft end.

18. The swirler assembly according to claim 12, wherein an angle of each of the plurality of grooves in the longitudinal direction in relation to the centerline axis has a range from zero to forty-five degrees.

19. The swirler assembly according to claim 17, wherein each of the plurality of grooves has a groove width (GW), and the depth (D) of each of the plurality of grooves has a range from 25% to 75% of the groove width (GW).

20. The swirler assembly according to claim 12, wherein each of the plurality of grooves has a groove width (GW), wherein a portion of the internal surface of the annular wall between each of the plurality of grooves defines a land, and wherein a land width (LW) of the land has a range from 50% to 150% of the groove width (GW).

* * * * *